United States Patent [19]

Spiess et al.

[11] 4,306,524

[45] Dec. 22, 1981

[54] OIL PUMP FOR A TWO-CYCLE INTERNAL COMBUSTION ENGINE

[75] Inventors: Karlheinz Spiess, Niederwerrn; Walter Hespelein, Werneck, both of Fed. Rep. of Germany

[73] Assignee: Fichtel & Sachs, Schweinfurt, Fed. Rep. of Germany

[21] Appl. No.: 77,155

[22] Filed: Sep. 19, 1979

[30] Foreign Application Priority Data

Sep. 26, 1978 [DE] Fed. Rep. of Germany ... 7828621[U]

[51] Int. Cl.[3] ..... F04B 17/00; F01M 11/00

[52] U.S. Cl. ..... 123/196 R; 123/198 C; 417/360

[58] Field of Search ..... 123/195 A, 198 C, 196 R; 417/360, 364; 184/26, 27 R

[56] References Cited

U.S. PATENT DOCUMENTS

| | | | |
|---|---|---|---|
| 3,781,137 | 12/1973 | Engstrom | 123/198 C X |
| 3,926,157 | 12/1975 | Lippitsch | 123/198 C X |
| 4,198,935 | 4/1980 | Seibt et al. | 123/198 C X |

FOREIGN PATENT DOCUMENTS

| | | | |
|---|---|---|---|
| 2102992 | 8/1971 | Fed. Rep. of Germany | 123/198 C |

*Primary Examiner*—Tony M. Argenbright
*Attorney, Agent, or Firm*—Toren, McGeady & Stanger

[57] ABSTRACT

An oil pump for a two-cycle internal combustion engine is mounted in a flange member which is attached to one end of the engine housing. The shaft of the oil pump is connected to the adjacent end of the crank shaft so that there is no relative rotation between the two shafts.

5 Claims, 2 Drawing Figures

OIL PUMP FOR A TWO-CYCLE INTERNAL COMBUSTION ENGINE

SUMMARY OF THE INVENTION

The present invention is directed to a two-cycle internal combustion engine, particularly for use on two-wheel vehicles, where the lubricating oil is supplied by an oil pump driven by the engine crank shaft.

Such an arrangement of a two-cycle internal combustion engine and an oil pump is needed when a so-called fuel and lubricating oil mixture is not used for lubricating the engine, but where the fuel and lubricating oil are filled in separate reservoirs in the internal combustion engine.

In a known two-cycle internal combustion engine, note French Pat. No. 71 39 911, an oil pump is formed by a hollow, sleeve-like portion of the crank shaft and a component which engages the sleeve-like portion. The oil pump is non-rotatably connected to the engine housing and includes a threaded portion. A cover encloses the pump from the outside. While this known arrangement of an oil pump requires little in the way of structure, it can be mounted only when the engine housing and the crank shaft are of an appropriate construction.

Therefore, the primary object of the present invention is to provide a mounting for an oil pump on an engine housing without requiring any special structural arrangement of the housing and the engine crank shaft prior to mounting the oil pump.

In accordance with the present invention, a flange member is attached to the end of the housing of the internal combustion engine at which a generator or a flywheel ignition magneto is located on the shaft. An oil pump is positioned within the flange member and a coaxial coupling is provided between the shaft of the oil pump and the adjacent end of the engine crank shaft so that a non-rotatable connection, relative one to the other, is afforded between the shaft and the crank shaft.

To provide a compact arrangement, it is advantageous if the flange member laterally enclosing the oil pump has an approximately cylindrical outer shape with a smaller diameter than the flange on the engine housing enclosing the end of the crank shaft on which the generator or flywheel ignition magneto is located. Further, the flange member includes a closure plate extending transversely of the axial direction of the shafts and forming a cover over the oil pump.

It may be advantageous if the flange member is approximately bell-shaped and includes a flange plate for supporting the oil pump with the flange pipe extending transversely of the axis of the crank shaft and located between the end of the crank shaft and the oil pump. In addition, the flange member located axially outward from the flange has a shell-like outer portion which serves as a cover for the oil pump.

Furthermore, it is also advantageous for providing a simple interconnection if the oil pump is arranged coaxially relative to the adjacent end of the crank shaft with a pivot having two cheeks or flat surfaces located on the end of the pump shaft with the pivot fitting into a transverse groove in the adjacent end of the crank shaft.

To obtain a particularly favorable design of the two-cycle combustion engine and oil pump with respect to operation, it is preferred if the groove in the crank shaft end into which the pivot of the pump shaft is fitted, is provided with a coupling piece of elastic material which can be slid onto a fastening nut on the end of the crank shaft. Any slight lateral misalignment of the axis of the crank shaft and the pump shaft can be compensated by the elastic coupling piece.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
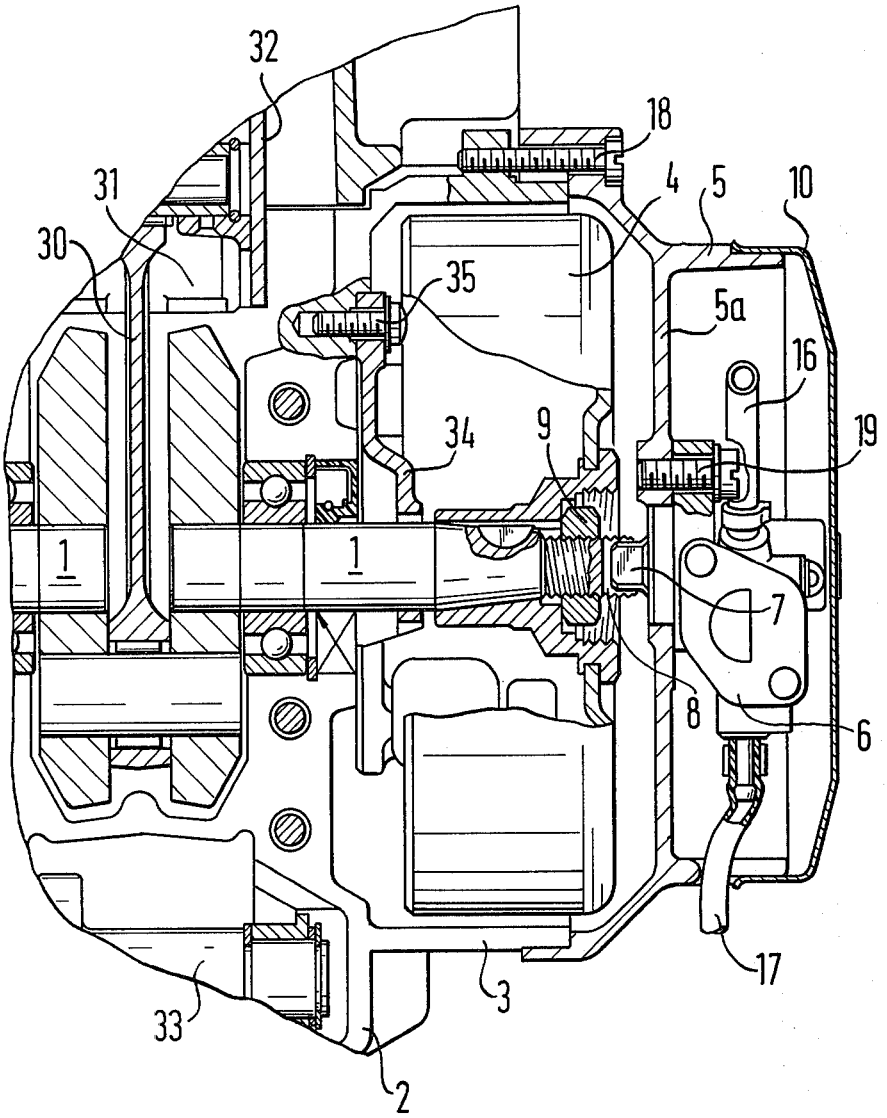
FIG. 1 is an axially extending sectional view of a portion of a two-cycle internal combustion engine with an oil pump connected to the end of the engine crank shaft at which the flywheel ignition magneto is located.
Figure 2:
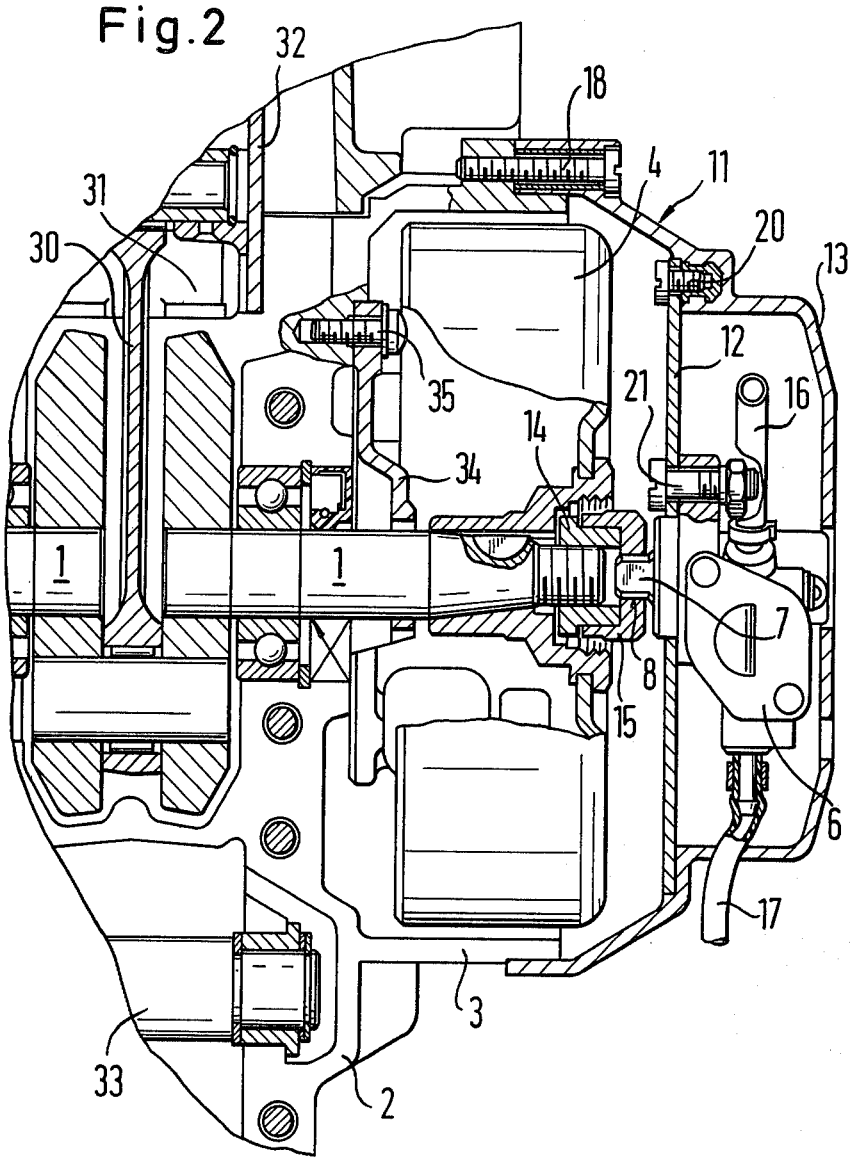
FIG. 2 is a view similar to FIG. 1 with a different arrangement of the flange member and the coupling for the oil pump.

In FIGS. 1 and 2 a portion of a two-cycle internal combustion engine is illustrated including a crank shaft 1 and an engine housing 2. One end of the crank shaft 1 is illustrated with a flywheel ignition magneto 4 positioned on the crank shaft and laterally enclosed by a flange 3 on the engine housing 2. The frusto-conical end of the crank shaft 1 illustrated in FIG. 1 carries a fastening nut 9, while in FIG. 2 the frusto-conical end of the crank shaft carries a fastening nut 14. A generator may be positioned on the crank shaft instead of the flywheel ignition magneto 4.

A separate oil pump 6 is located adjacent to and spaced outwardly from the frusto-conically shaped end of the crank shaft 1. The pump 6 is arranged coaxially with the crank shaft 1 so that a direct drive can be provided for the pump by means of a specially designed flange member 5 fastened to the engine housing flange 3 by screws 18.

In the embodiment shown in FIG. 1, the part of the flange member 5 extending axially outwardly away from the end of the engine housing 2 has a smaller diameter than that of the housing flange 3 to which the flange member is attached. A one piece flange member wall portion 5*a* extends transversely of the axial direction of the crank shaft 1 and is located between the pump 6 and the adjacent end of the crank shaft. The oil pump 6 is secured to the wall 5*a* by means of screws 19. A cover 10 is fitted onto the opposite end of the cylindrically shaped part of the flange member 5 from the walls 5*a*. The cover 10 is a stamped sheet metal piece. The end of the shaft of the separate oil pump 6 adjacent the crank shaft has a pivot 7 with two laterally spaced cheeks or flat surfaces which fit into a correspondingly shaped groove 8 in the adjacent end of the crank shaft 1 so that the crank shaft drives the oil pump by its interconnection with the pivot 7. Relative to one another, the crank shaft 1 and the shaft of the oil pump 6 are non-rotatably coupled together.

Lubricating oil to be conveyed by the oil pump 6 is supplied through a hose 16 from a reservoir, not shown, located above the pump. From the pump 6, the lubricating oil flows into the intake section of the engine through a tube 17. Advantageously, the tube 17 can be made transparent. At the end of the supply tube 17, a pressure control or relief valve is arranged and opens toward the intake section when the oil pump operates, however, the valve closes when the oil pump is not in operation. Accordingly, lubricating oil is prevented from flowing into the engine in an uncontrolled manner as a result of the static pressure in the oil reservoir, when the engine is not running.

In the embodiment of the invention displayed in FIG. 2, the two-cycle internal combustion engine is of the same basic design as the one illustrated in FIG. 1. There is a difference, however, in the arrangement of the flange member 11 which supports the oil pump 6 and is fastened to the flange 3 of the engine housing by screws 18. Flange member 11 is approximately bell-shaped. In its interior, the flange member 11 has a flange plate 12 extending transversely of the crank shaft and formed as a planar piece of sheet metal. Screws 20 secure the separate flange plate 12 to the flange member 11. Flange plate 12 spans the opening in the flange member 11 and is located between the adjacent end of the crank shaft 1 and the oil pump 6. Screws 21 with nuts attached connect the oil pump 6 to the flange plate 12. Shell-like outer portion 13 of the flange member 11 forms a cover over the oil pump 6.

In this embodiment, the oil pump 6 is non-rotatably connected to the end of the crank shaft 1 by a pivot 7 with two cheeks which extends into a correspondingly shaped groove 8 provided in a coupling piece 15. Coupling piece 15 is slid onto the fastening nut 14 located on the end of the crank shaft 1. An elastic material, resistant to vibrations and to oil, is used for the coupling piece 15.

Oil pump 6 is connected to a reservoir for lubricating oil through a hose 16 and is connected to the intake section of a two-cycle internal combustion engine through a tube 17 with the interposition of a relief valve. The hose 16 and tube 17 have been described in connection with FIG. 1.

In addition to the components described above, the following components are shown in FIGS. 1 and 2. A connecting rod 30 interconnects crank shaft 1 with a piston 31. Piston 31 reciprocates in a cylinder 32 and a transmission shaft 33 is illustrated in the lower part of FIGS. 1 and 2. A base plate 34 of flywheel ignition magneto 4 is connected to the engine housing 2 by a screw 35.

In the following there is a brief description of the conversion of a two-cycle internal combustion engine operated by a mixture of fuel and lubricating oil in the fuel tank to an engine operated with a separate lubricating oil supply and with only pure fuel in the fuel tank. A two-cycle engine operated with a fuel-lubricating oil mixture corresponds, for example, to the engine shown in FIG. 2, with the difference that a simple cover is located over the flywheel ignition magneto 4 and screwed onto the housing flange 3, instead of the flange member 11 including the oil pump 6. To convert the engine, the cover is removed, the coupling piece 15 is slid onto the fastening nut 14 at the frusto-conical end of the crank shaft 1, and, subsequently, the flange member 11 along with the oil pump 6, the hose 16 and the pipe 17, is screwed onto the flange 3 of the engine housing 2. It must be ensured that the pivot 7 on the free end of the oil pump shaft interengages the corresponding groove 8 in the coupling piece 15. Subsequently, hose 16 is connected to a lubricating oil reservoir and the tube 17 is connected to the intake section of the engine by means of an additional connection to the carburetor. The above-mentioned valve is located in the tube 17.

As soon as the engine is started up, the rotating crank shaft 1 drives the oil pump 6 which pumps lubricating oil into the intake section of the engine so that the fuel gases containing the lubricating oil are drawn into the combustion chamber, much in the same manner as in the operation with the fuel-lubricating oil mixture prior to the conversion of the engine. When the engine is stopped, the release valve closes and prevents additional oil from flowing into the intake section.

Since, as mentioned above, the housing 2 and the crank shaft 1 of both types of engines do not differ from one another, whether operating with a fuel-lubricating oil mixture or with a separate lubricating oil supply, the change from one type of engine operation to the other can be made without any significant adjustments in the mass production of the engine.

While specific embodiments of the invention have been shown and described in detail to illustrate the application of the inventive principles, it will be understood that the invention may be embodied otherwise without departing from such principles.

What is claimed is:

1. Two-cycle internal combustion engine, particularly for use in a two-wheel vehicle, comprising an engine housing, a crank shaft positioned within said housing and having a first end at one end of said housing for mounting one of a generator or a flywheel ignition magneto, a flange member attached to and extending outwardly from the one end of said housing, an oil pump supported within said housing, said oil pump including a shaft, means for providing a co-axial non-rotatable connection between said shaft of said oil pump and the first end of said crank shaft, said flange member having a first part connected to said engine housing, a second part extending outwardly from said first part away from said engine housing in the axial direction of said crank shaft and laterally enclosing said pump, said second part having an outer cylindrical shape and having a smaller diameter than the diameter of said housing to which said first part is connected, and a third part attached to said second part at a location spaced from said first part and extending transversely of the axial direction of said crank shaft and forming a cover for said oil pump.

2. Two-cycle combustion engine, particularly for use in a two-wheel vehicle, comprising an engine housing, a crank shaft positioned within said housing and having a first end at one end of said housing for mounting one of a generator or flywheel ignition magneto, a flange member attached to and extending outwardly from the one end of said housing, an oil pump supported within said housing, said oil pump including a shaft, means for providing a co-axial non-rotatable connection between said shaft of said oil pump and the first end of said crank shaft, said flange member is bell-shaped, said flange member including a plate extending transversely of the axial direction of said crank shaft and located between said crank shaft and said oil pump with said oil pump supported on said plate, and a shell-like portion laterally enclosing said oil pump and having a part thereof extending transversely of the axial direction of said crank shaft and spaced on the opposite side of said oil pump from said plate and serving as a cover for said oil pump.

3. Two-cycle internal combustion engine, as set forth in claims 1 or 2, wherein the end of said crank shaft adjacent said oil pump has a shaped groove therein and the end of said shaft of said oil pump spaced outwardly from said oil pump has a shape corresponding to the shape of said groove in said crank shaft so that the end of said shaft of said oil pump interengages within said groove in said crank shaft so that a non-rotatable interconnection is formed between said crank shaft and said shaft of said oil pump.

4. Two-cycle internal combustion engine, as set forth in claim 3, wherein the end of said shaft of said oil pump comprises a pivot having two laterally spaced flat cheeks extending in the axial direction of said shaft and said groove having a pair of laterally spaced flat faces for interengaging said cheeks on said pivot.

5. Two-cycle internal combustion engine, particularly for use in a two-wheel vehicle, comprising an engine housing, a crank shaft positioned within said housing and having a first end at one end of said housing for mounting one of a generator or a flywheel ignition magneto, a flange member attached to and extending outwardly from the one end of said housing, an oil pump supported within said housing, said oil pump including a shaft, means for providing a co-axial non-rotatable connection between said shaft of said oil pump and the first end of said crank shaft, a fastening nut is secured on the end of said crank shaft adjacent said oil pump, a coupling piece formed of an elastic material being slid onto said fastening nut, said coupling piece having a face extending transversely of the axial direction of said crank shaft, said groove being formed in the transverse face of said coupling piece, and the end of said shaft of said oil pump being interengaged in said groove in said coupling piece.

* * * * *